US011078782B2

(12) United States Patent
Ang et al.

(10) Patent No.: US 11,078,782 B2
(45) Date of Patent: Aug. 3, 2021

(54) SYSTEM TO ENHANCE TELEMETRY COMMUNICATION IN WELL INTERVENTION OPERATION

(71) Applicant: Halliburton Energy Services, Inc., Houston, TX (US)

(72) Inventors: Yi Yang Ang, Singapore (SG); Yifei Yang, Singapore (SG); Colin Eu Leem Koo, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/732,310

(22) Filed: Jan. 1, 2020

(65) Prior Publication Data

US 2021/0199004 A1 Jul. 1, 2021

(51) Int. Cl.

| | |
|---|---|
| ***E21B 47/26*** | (2012.01) |
| ***G10K 11/00*** | (2006.01) |
| ***E21B 47/14*** | (2006.01) |

(52) U.S. Cl.

CPC ..... *E21B 47/26* (2020.05); *E21B 47/14* (2013.01); *G10K 11/002* (2013.01); *G10K 2210/108* (2013.01)

(58) Field of Classification Search

CPC ..... E21B 47/26; E21B 47/12; G01K 11/002; G01K 2210/108

See application file for complete search history.

(56) References Cited

U.S. PATENT DOCUMENTS

| | | | | |
|---|---|---|---|---|
| 6,385,773 | B1 * | 5/2002 | Schwartzman | ..... H04L 12/2801 348/E7.07 |
| 6,741,185 | B2 | 5/2004 | Shi et al. | |
| 7,348,894 | B2 | 3/2008 | Bailey et al. | |

(Continued)

FOREIGN PATENT DOCUMENTS

| | | | |
|---|---|---|---|
| WO | 2018174900 | A1 | 9/2017 |
| WO | 2018070998 | A1 | 4/2018 |

OTHER PUBLICATIONS

International Search Report and Written Opinion for PCT application PCT/US2020/012002 dated Sep. 25, 2020, 12 pages.

(Continued)

*Primary Examiner* — Amine Benlagsir
(74) *Attorney, Agent, or Firm* — Locke Lord LLP

(57) ABSTRACT

System and method for telemetry communication provide enhance noise cancellation in well intervention operations. The system and method employ a surface panel operable to transmit and receive a telemetry signal through a wireline extending along a wellbore. A power converter receives and converts electrical power from the cable to operating power for a downhole tractor motor. A modem coupled to the cable processes and provides the telemetry signal to a microcontroller. A noise signal pathway provides a noise signal from the tractor motor directly to the microcontroller, the noise signal representative of electrical noise generated by the downhole tractor. The microcontroller performs noise cancellation on the telemetry signal to produce a de-noised telemetry signal by obtaining an estimated noise channel transfer function for the noise signal, and applying the estimated noise channel transfer function and the noise signal to the telemetry signal from the modem.

20 Claims, 6 Drawing Sheets

(56) References Cited

U.S. PATENT DOCUMENTS

| | | | | |
|---|---|---|---|---|
| 7,639,562 | B2 | 12/2009 | Patterson et al. | |
| 8,111,171 | B2 | 2/2012 | Clark | |
| 2002/0196876 | A1* | 12/2002 | Takada | H04B 1/7101 375/346 |
| 2006/0227005 | A1* | 10/2006 | Fincher | H04L 25/0228 340/855.4 |
| 2008/0002524 | A1 | 1/2008 | Wassermann et al. | |
| 2008/0074948 | A1 | 3/2008 | Reckmann | |
| 2008/0133982 | A1* | 6/2008 | Rawlins | H03F 1/3294 714/699 |
| 2010/0307828 | A1 | 12/2010 | Hutin et al. | |
| 2014/0341388 | A1* | 11/2014 | Goldstein | H04R 3/04 381/71.11 |
| 2017/0204722 | A1 | 7/2017 | Tran et al. | |
| 2017/0260851 | A1* | 9/2017 | Rendusara | F04D 13/10 |
| 2018/0128100 | A1 | 5/2018 | Benson | |
| 2019/0052374 | A1 | 2/2019 | Lie et al. | |
| 2019/0389505 | A1* | 12/2019 | Pramod | H02P 21/0003 |

OTHER PUBLICATIONS

Ranjan Walia, et al., "Design of active noise control system using hybrid functional link artificial meural network and finite impulse response filters", Neural Computing and Applications vol. 32, Sep. 24, 2018, pp. 2257-2266.

* cited by examiner

SYSTEM TO ENHANCE TELEMETRY COMMUNICATION IN WELL INTERVENTION OPERATION

TECHNICAL FIELD

The exemplary embodiments disclosed herein relate generally to downhole tools for oil and gas wells, and, more specifically to systems and methods to decrease the noise interference in power line communication on the telemetry for a well intervention tractor system.

BACKGROUND

In the oil and gas industry, telemetry systems are used to communicate data collected from downhole tools to receiving equipment at the surface for monitoring and processing. These telemetry systems may be used during drilling as well as well intervention where downhole tools are lowered into a wellbore to perform maintenance, remedial, and other operations. Collecting data about a drilling assembly or about the wellbore environment contemporaneously with an intervention operation allows a well operator to control and optimize performance of downhole tools and drilling assemblies. The collection of data is particularly useful in horizontal drilling where additional challenges can arise that are not typically encountered in conventional drilling.

In horizontal drilling, however, it can often be difficult and costly to obtain measurements because gravity cannot be used to lower measurement tools from a wireline or slickline unit or other gravity-assisted conveyance systems. One solution is to use well tractors that can pull the tools through the horizontal portion of the wellbore. A well tractor typically has a modular structure containing a powered wheel section or similar mechanism that propels the desired measurement tool through the wellbore as cable is fed off a reel located on the wireline truck at the surface.

While downhole tractors offer many advantages over more conventional conveyances in horizontal wells, the tractors can generate electrical noise that interferes with telemetry signals in wireline telemetry systems. Additionally, the nature of the noise tends to be in-band noise, or noise that is within the same or similar frequency range as the frequency range used for the telemetry signals. Using passive filters alone for in-band noise removal have proven unsatisfactory for a variety of reasons. Additional in-band noise may also be generated by other sources at the surface, which can further interfere with the telemetry signal on the wireline.

Therefore, improvements are needed for mitigating noise interference in downhole telemetry systems while using a downhole tractor, particularly where the noise is in-band noise.

BRIEF DESCRIPTION OF THE DRAWINGS

For a more complete understanding of the exemplary disclosed embodiments, and for further advantages thereof, reference is now made to the following description taken in conjunction with the accompanying drawings in which.

DESCRIPTION OF EXEMPLARY EMBODIMENTS

The following discussion is presented to enable a person ordinarily skilled in the art to synthesize and use the exemplary disclosed embodiments. Various modifications will be readily apparent to those skilled in the art, and the general principles described herein may be applied to embodiments and applications other than those detailed below without departing from the spirit and scope of the disclosed embodiments as defined herein. Accordingly, the disclosed embodiments are not intended to be limited to the particular embodiments shown, but are to be accorded the widest scope consistent with the principles and features disclosed herein.

Embodiments of the present disclosure provide systems and methods for removing in-band noise from borehole telemetry signals, such as noise generated by a well tractor as it draws electric current to operate. This tractor noise can interfere significantly with borehole telemetry signals, including corrupting the data and information in the telemetry signals. The systems and methods herein cancel out the in-band noise from the telemetry signal by employing an active noise cancellation approach. In one embodiment of this approach, the systems and methods actively generate an "anti-noise" signal, then combine the "anti-noise" signal with the corrupted telemetry signal to cancel out the in-band noise, resulting in a much clearer telemetry signal. Additionally, embodiments of the disclosure allow the noise cancellation to be done within a downhole tool, without needing additional electrodes and/or magnets at the surface or along the borehole casing. This greatly improves the fidelity and robustness of the telemetry system.

Figure 1:
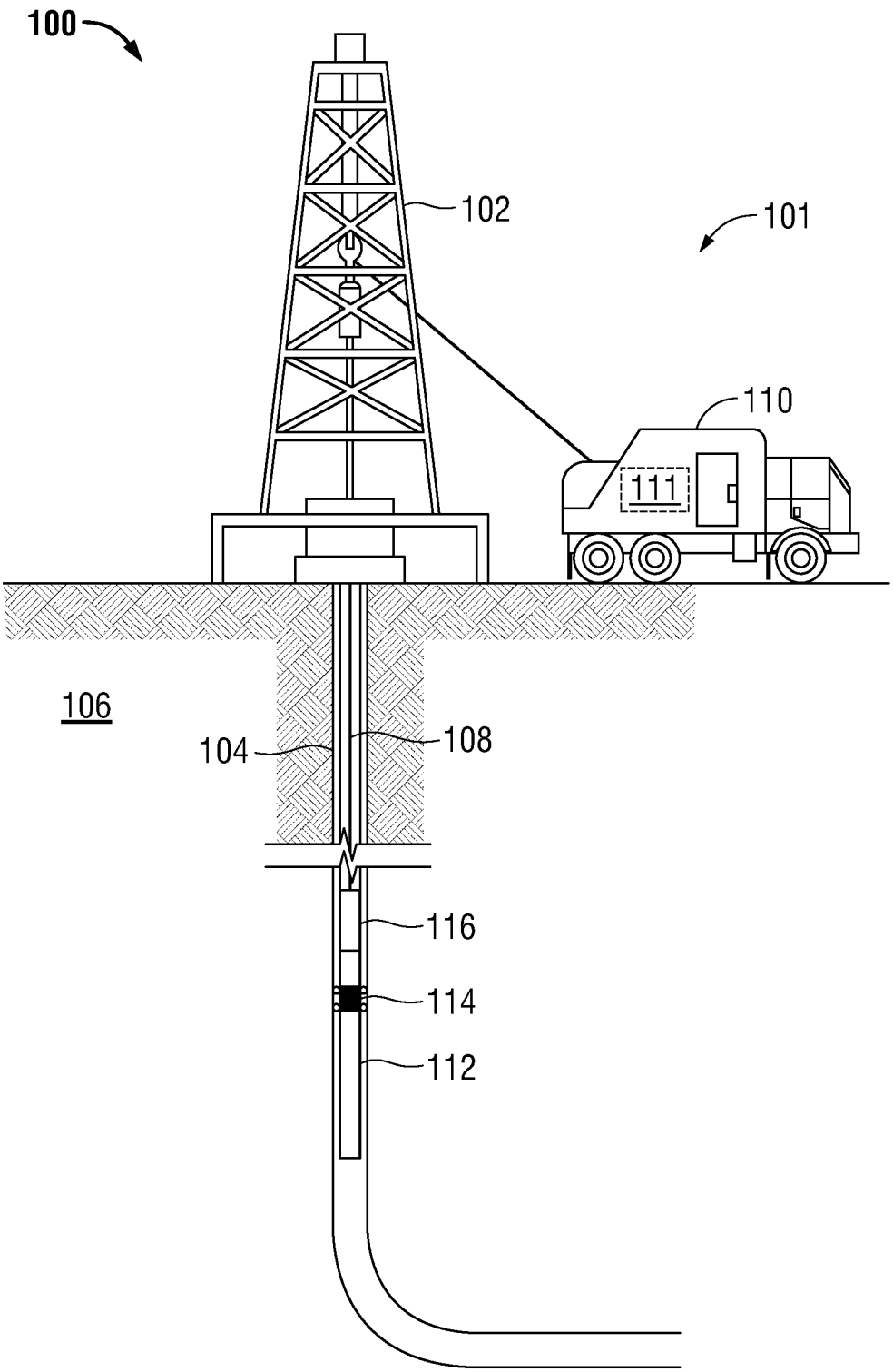
FIG. 1 is a schematic diagram showing a well site in which embodiments of the present disclosure may be used.

Referring now to FIG. 1, a partial view of a well site 100 is shown in which an intervention system 101 may be deployed for performing well intervention operations according to embodiments of the present disclosure. The well site 100, which may be located offshore or onshore (as depicted in this example), includes a rig 102 for conveying downhole equipment and tools into a wellbore 104 in a subterranean formation 106. In the example, the rig 102 is being used to deploy the intervention system 101 by suspending a wireline 108 being spooled into the wellbore 104 from a wireline unit 110, such as a wireline truck. A downhole tool 112 is attached to the wireline 108 and conveyed into the wellbore 104, specifically a horizontal section thereof, by at least one well tractor 114. It is of course possible to convey the tool 112 into the wellbore 104 using other conveyance means, such as slickline, coiled tubing, and the like, within the scope of the disclosed embodiments.

A control panel 111, also called a surface panel, may be located in or proximate to the wireline unit 110 for allowing user control of the tool 112 and tractor 114 from the surface. Although not detailed herein, the surface panel 111 typically includes conventional computing capability and user interface equipment, such as a keypad or keyboard, mouse, video displays, and so forth. The surface panel 111 also typically includes information handling systems and one or more data buses as well as a network interface that allows the surface panel to transmit and receive communications to and from other systems. Other components typically contained in the surface panel 111 may include random access memory (RAM), one or more processing resources, such as a microcontroller or central processing unit (CPU), hardware and/or software control logic, a read-only memory (ROM), and the like.

In operation, the user uses the surface panel 111 to control the well tractor 114 to convey the tool 112 into the wellbore 104 as the wireline unit 110 spools the wireline 108 into the wellbore 104. The user also uses the surface panel 111 to control the tool 112 to perform data collection operations and other downhole operations. A telemetry module 116 is coupled to the tool 112 at the wireline end thereof to facilitate communication between the surface panel 111 and the tool 112. The telemetry module 116 is directly connected to and sends and receives telemetry signals on the wireline 108, which also serves as the primary electrical pathway between the tool 112 and equipment at the surface for power transmission purposes.

As mentioned earlier, operating the well tractor 114 generates electrical noise that can interfere with the telemetry signals transiting the wireline 108. Additionally, the noise that the well tractor 114 generates is in-band noise, which makes it more challenging to avoid or remove from the telemetry signals. This is due partly to the wireline 108 being a coaxial cable that behaves effectively as a high-order low-pass filter, which limits the range of carrier frequencies that can provide good performance on the wireline 108. While higher carrier frequencies may be able to avoid the tractor noise, the higher frequency signals tend to experience more attenuation on the wireline 108 due to the high-order low-pass filter effect, especially over extremely long distances as typically encountered in horizontally drilled wells. Therefore, in accordance with the present disclosure, the telemetry module 116 is equipped with active noise cancellation capability that can cancel out the tractor noise to a much greater extent than heretofore achieved by existing solutions, as detailed herein.

Figure 2:
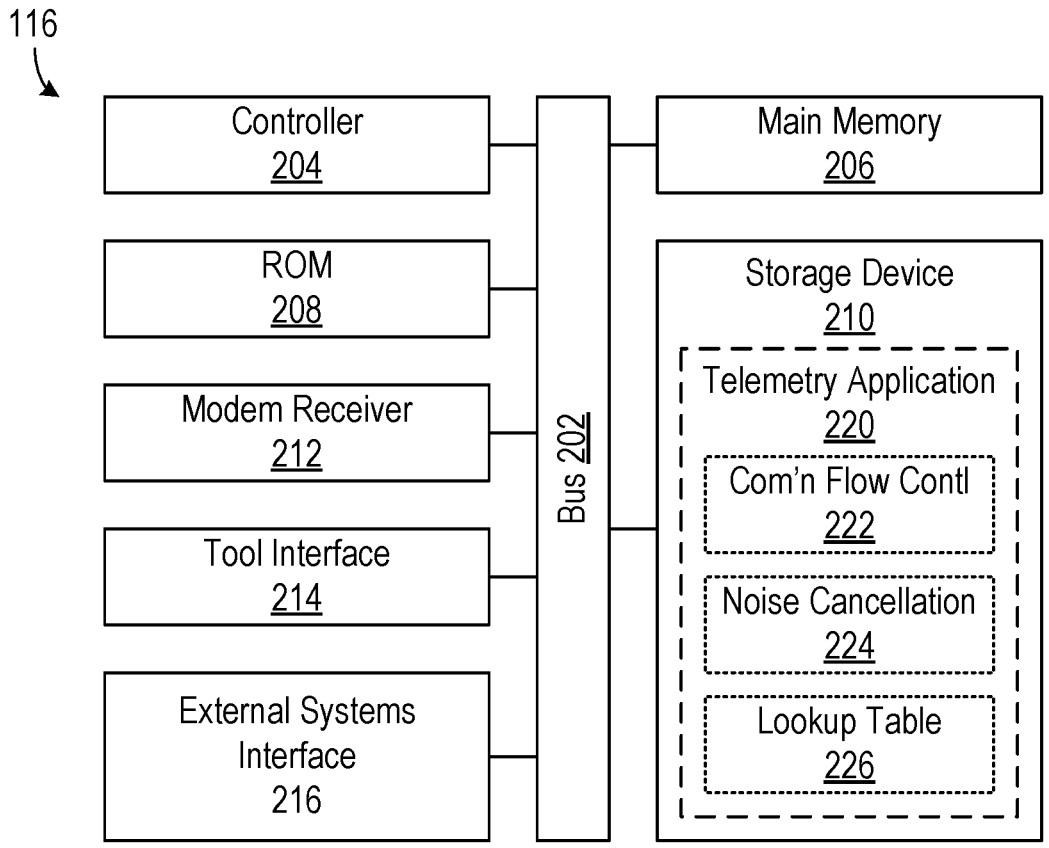
FIG. 2 is a block diagram illustrating an exemplary architecture for a telemetry module used in embodiments of the present disclosure.

FIG. 2 is a block diagram illustrating an exemplary architecture for the telemetry module 116 according to embodiments of the present disclosure. In this example, the telemetry module 116 includes a bus 202 or other communication pathway for transferring information among various components, and a controller 204 coupled to the bus 202 for processing the information. The telemetry module 116 may also include a main memory 206, such as a random-access memory (RAM) or other dynamic storage device coupled to the bus 202 for storing computer-readable instructions to be executed by the controller 204. The main memory 206 may also be used for storing temporary variables or other intermediate information during execution of the instructions by the controller 204.

The telemetry module 116 may further include a read-only memory (ROM) 208 or other static storage device coupled to the bus 202 for storing static information and instructions for the controller 204. A computer-readable storage device 210, such as a nonvolatile memory (e.g., Flash memory) drive or magnetic disk, may be coupled to the bus 202 for storing information and instructions for the controller 204. The controller 204 may also be coupled via the bus 202 to a modem 212 for sending and receiving telemetry signals to and from a surface system, such as the surface panel 111. A tool interface 214 is coupled to the bus 202 for communicating information to and from the tool 112. An external systems interface 216 may be provided for allowing the telemetry module 116 to communicate with one or more external systems downhole, such as the well tractor 114.

The term "computer-readable instructions" as used above refers to any instructions that may be performed by the controller 204 and/or other components. Similarly, the term "computer-readable medium" refers to any storage medium that may be used to store the computer-readable instructions. Such a medium may take many forms, including, but not limited to, non-volatile media, volatile media, and transmission media. Non-volatile media may include, for example, optical or magnetic disks, solid-state memory, and the like, such as the storage device 210. Volatile media may include dynamic memory, such as main memory 206. Transmission media may include coaxial cables, copper wires, fiber optics, and the like.

In accordance with embodiments of the present disclosure, a telemetry application 220, or the computer-readable instructions therefor, may reside on or be downloaded to the storage device 210 for execution. The telemetry application 220 operates to perform telemetry related functionality for the telemetry module 116, including functionality for managing and controlling the flow of information to and from various systems connected to the telemetry module 116, indicated at 222. The telemetry application 220 also operates to provide noise cancellation functionality on the telemetry signals received by the telemetry module 116, including functionality for active cancellation of the in-band noise generated by the well tractor 114, indicated at 224. In some embodiments, the in-band noise cancellation indicated at 224 may be performed using a lookup table 226 containing transfer function filter coefficients, as explained later herein. Such a telemetry application 220 may be a standalone application or it may be integrated with other applications as part of a larger software package. The active cancellation of in-band noise is described in more detail below with respect to FIGS. 3A-3D.

Figure 3A:
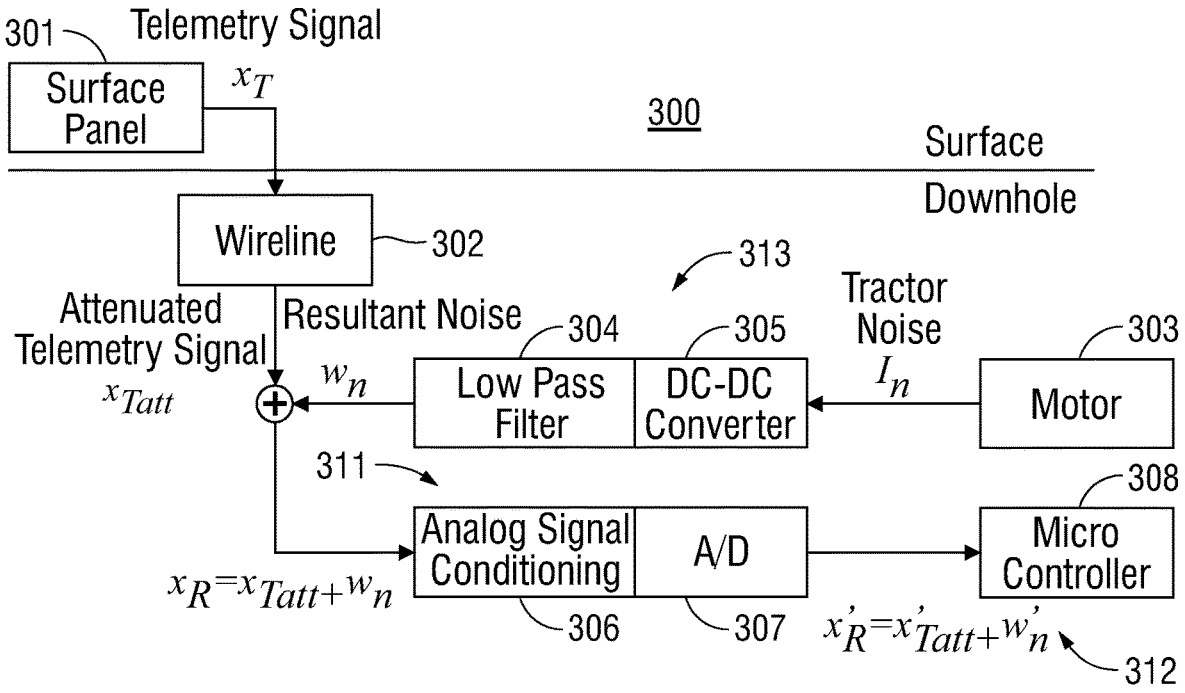
FIGS. 3A-3D are block diagrams showing a well telemetry system according to embodiments of the present disclosure.

Referring to FIG. 3A, a block diagram representing a well telemetry system 300 equipped with active noise cancellation capability according to embodiments of the present disclosure is shown. As can be seen, the telemetry system 300 is a wireline telemetry system having many of the same components previously described in FIG. 1, including a surface panel 301 connected by a wireline 302 to a telemetry module 312. The wireline 302, as explained in FIG. 1, conveys telemetry signals and power to the telemetry module 312 as well as to a motor 303. The motor 303 may be any type of motor that can be used downhole, such as a well tractor motor. Power for the tractor motor 303 is provided by a power converter 313. A low-pass filter 304 in the power converter 313 filters out any high frequency components and a DC-DC converter 305 converts the power to an appropriate operating voltage for the tractor motor 303. In a similar manner, the telemetry signals are received by a modem receiver 311 in the telemetry module 312 where an analog signal conditioner 306 conditions the signals and an analog-to-digital (A/D) converter 307 converts the signals to a digital format. The modem receiver 311 thereafter provides the converted telemetry signals to a controller 308 of the telemetry module 312, which may be a microcontroller or the like, for further processing and forwarding.

In the example shown, the microcontroller 308 is programmed to execute a telemetry application (e.g., telemetry application 220) that includes functionality for controlling the flow of telemetry signals processed by the microcontroller 308 (e.g., communication flow control 222), as well as functionality that provides noise cancellation for the telemetry signals (e.g., noise cancellation 224), including active cancellation of any in-band noise generated by the tractor motor 303.

In operation, telemetry signal $x_T$ from the surface panel 301 travels down the wireline 302 to the telemetry module 312. The telemetry signal is attenuated as a function of the length of the wireline 302 and is designated $x_{Tatt}$. When tractor motor 303 draws current from wireline 302, it creates tractor noise $I_n$ that is passed back through other electrical circuits between the tractor motor 303 and the wireline 302, including the low pass filter 304 and DC-DC converter 305, to create a resultant noise signal $w_n$. That resultant noise signal $w_n$ is combined with the attenuated telemetry signal $x_{Tatt}$ and any other signals on the wireline 302 to produce a resultant telemetry signal $x_R=x_{Tatt}+w_n$. The resultant telemetry signal $x_R$ is then processed by the modem receiver 311 to produce a processed telemetry signal $x_R'=x_{Tatt}'+w_n'$ that is provided as an input to the microcontroller 308.

Figure 3B:
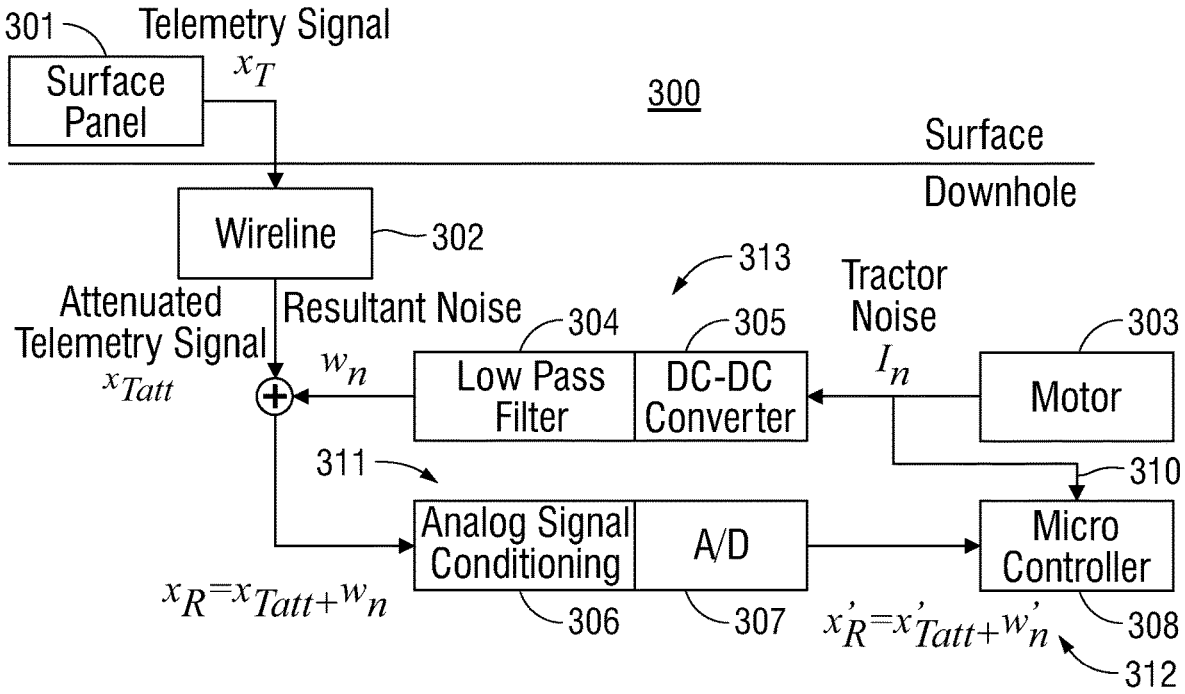

Referring now to FIG. 3B, in order to remove the tractor noise signal $I_n$, embodiments of the present disclosure implement a noise signal pathway 310, such as an electrical connection, between the motor 303 and the microcontroller 308 that provides the tractor noise signal $I_n$, or information therefor, directly to the microcontroller 308. The microcontroller 308 may then store or otherwise record the tractor noise signal $I_n$ in computer memory (e.g., main memory 206, storage device 210, etc.) for use in cancelling the noise signal according to embodiments of the disclosure. This allows the telemetry system 300 to produce a much clearer telemetry signal with greatly improved fidelity.

In some embodiments, the microcontroller 308 provides the noise cancellation functionality in four main steps or stages: (a) calibration for noise, (b) noise cancellation, (c) bit error rate checking, and (d) repetition of (a)-(c).

Figure 3C:
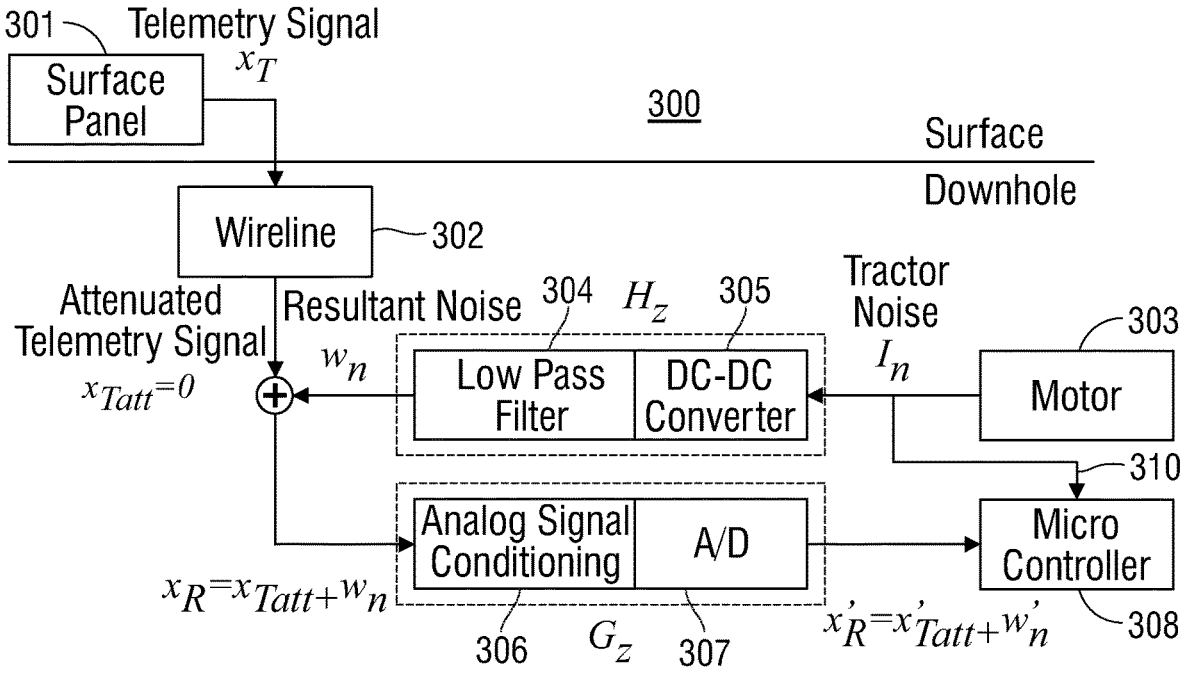

FIG. 3C graphically illustrates some of the actions that take place in the calibration for noise stage to identify or characterize the noise. In this stage, the tractor noise signal $I_n$ is processed in the absence of the telemetry signal $x_T$ to produce a calibration noise signal $I_n'$. This can be done by setting the telemetry signal $x_T$, and hence the attenuated telemetry signal $x_{Tatt}$, equal to zero, for example, by disconnecting or otherwise removing the telemetry signal from the wireline 302. Next, the tractor motor 303 is activated, which causes the motor 303 to draw current and thereby generate the tractor noise signal $I_n$. The tractor noise signal $I_n$ is then provided via the noise signal pathway 310 to the microcontroller 308 for recording and performing calibration.

Calibration proceeds by obtaining a channel transfer function for the noise, $\hat{F}_z$, which is the transfer function that would be encountered by the tractor noise signal $I_n$ passing through the power converter 313 and subsequently the modem receiver 311. In some embodiments, the noise channel transfer function $\hat{F}_z$ may be obtained by using an approximation, $\hat{F}_z=H_zG_z$, where $G_Z$ and $H_Z$ are the transfer functions for the modem receiver 311 and the power converter 313, respectively. This estimate of the noise channel transfer function $\hat{F}_z$ may be derived as follows:

$$w_n = I_n H_Z \tag{1}$$

$$x_R = x_{Tatt} + w_n \tag{2}$$

$$x_R' = x_R G_Z = [x_{T_{att}} + w_n]G_z|_{x_{T_{att}}=0, w_n=I_n H_z} = I_n H_z G_z \tag{3}$$

-continued $$\therefore x_R'|_{x_{T_{att}}=0} = I_n' = I_n H_z G_z \tag{4}$$

$$H_z G_z = \frac{I_n'}{I_n} = \hat{F}_z \tag{5}$$

In the foregoing Equation 1 shows the resultant noise signal $w_n$ in terms of the power converter transfer function $H_Z$, Equation 2 shows the resultant telemetry signal $x_R$ input into the modem, and Equation 3 shows the output signal of the modem $x_R'$ in terms of the modem transfer function $G_Z$. The calibration noise signal $I_n'$ is obtained by setting the attenuated telemetry signal $x_{Tatt}$ equal to 0 in Equation 3, resulting in Equation 4 (i.e., the calibration noise signal $I_n'$ is the noise signal noise $I_n$ getting processed without the telemetry signal $x_T$). Rearranging the variables in Equation 4 produces the estimate of the noise channel transfer function $\hat{F}_z$ mentioned above, as shown in Equation 5.

Figure 3D:
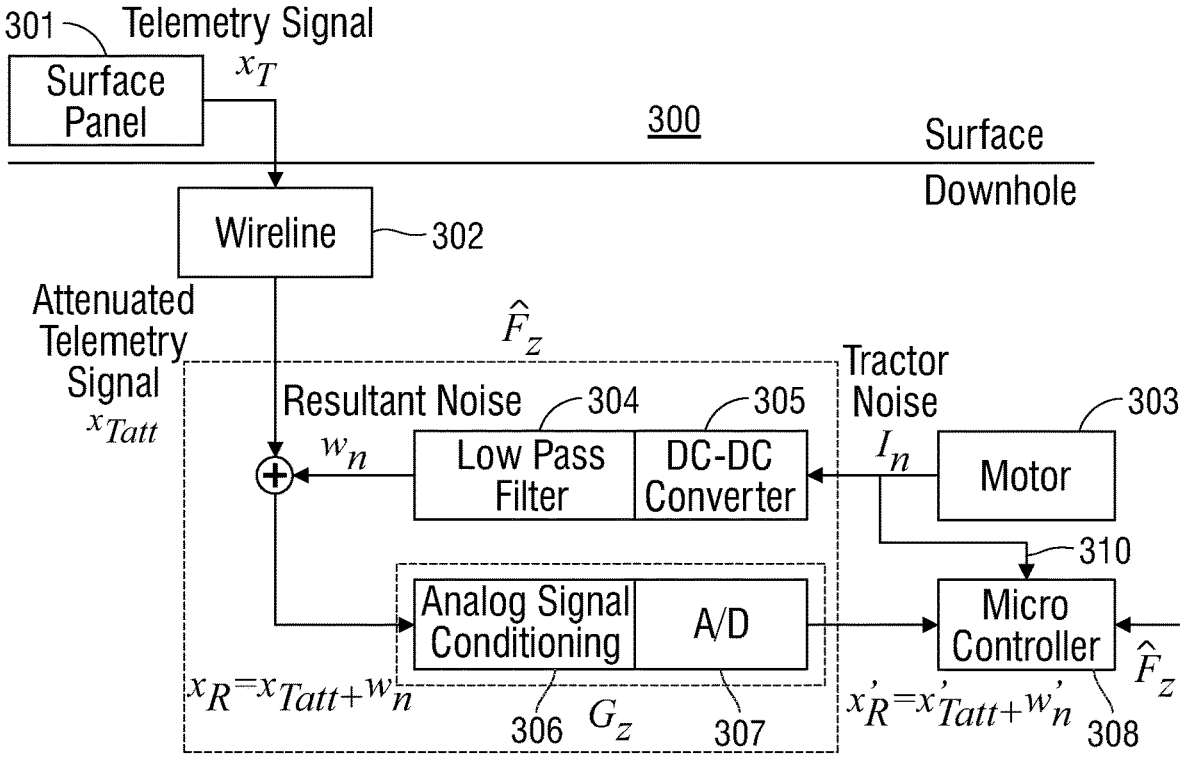

Once the estimate of the noise channel transfer function $\hat{F}$ is obtained, the noise cancellation stage may be performed, as depicted in FIG. 3D. Referring to FIG. 3D, noise cancellation proceeds by first reconnecting the telemetry signal $x_T$ back to the wireline 302 or otherwise restoring the signal such that the attenuated telemetry signal $x_{Tatt}\neq 0$. That telemetry signal then becomes combined with the resultant noise signal $w_n$ to produce the resultant telemetry signal $x_R$. The resultant telemetry signal $x_R$ is subsequently processed by the modem 311 to produce a processed telemetry signal $x_R'$ that is input into the microcontroller 308, which performs noise cancellation on the telemetry signal.

Noise cancellation may proceed by observing that the input telemetry signal $x_R'$ can be expressed in terms of the modem transfer function $G_z$, as follows:

$$\begin{aligned} x_R' &= x_R G_z \\ &= [x_{T_{att}} + w_n]G_z \\ &= [x_{T_{att}} + I_n H_z]G_z \\ &= [x_{T_{att}} G_z + I_n H_z G_z] \end{aligned} \tag{6}$$

As can be seen, the noise term in the third derivation, $I_nH_zG_z$, is actually the product of the tractor noise $I_n$ and the noise channel transfer function $\hat{F}_z$ where $\hat{F}_z=H_zG_z$. Therefore, a de-noised telemetry signal $x_{R_{de\text{-}noised}}'$ can be achieved by subtracting out the noise term $I_n\hat{F}_z$, leaving only the attenuated original telemetry signal $x_{Tatt}$ times the modem transfer function $G_z$, as follows:

$$\begin{aligned} x_{R_{de-noised}}' &= x_R' - I_n \hat{F}_z \\ &= x_R' - I_n H_z G_z \\ &= [x_{T_{att}} G_z + I_n H_z G_z] - I_n H_z G_z \\ &= x_{T_{att}} G_z \end{aligned} \tag{7}$$

The $I_n\hat{F}_z$ term may thus be considered as a sort of "anti-noise" term that can be used to subtract or cancel out the noise term in the processed telemetry signal $x_R'$.

Accordingly, as illustrated above, noise cancellation may be performed by providing the microcontroller 308 with the tractor noise signal $I_n$ and the noise channel transfer function $\hat{F}_z$. The tractor noise signal $I_n$ may be provided to the microcontroller 308 via the noise signal pathway 310 mentioned earlier, and the noise channel transfer function $\hat{F}_z$ may be provided by providing the modem transfer function $G_Z$ and the power converter transfer function $H_Z$, per Equation 4. The microcontroller 308 may then perform noise cancellation by subtracting the product of the tractor noise signal $I_n$ and the noise channel transfer function $\hat{F}_z$ from the processed telemetry signal $x_R'$. In some embodiments, the transfer functions $\hat{F}_z$ and $G_Z$, or rather the filter coefficients therefor, may be stored in a lookup table (e.g., lookup table 226) in a memory of the telemetry module 312 (e.g., storage device 210). The transfer functions may then be looked up using, or based on, the current operating parameters and downhole environment of the telemetry system, such as temperature and operating voltage, and the like.

Note for reference purposes that variables having a hat symbol (e.g., $\hat{F}$) in the above equations designate an estimate of said variable, whereas variables without a hat refer to the actual variable. Due to variability in operating parameters of the downhole environment and the telemetry system, the noise channel transfer function $\hat{F}_z$ may drift over time as the system is used. Therefore, $\hat{F}_z$ will generally need be updated from time to time to account for any drift. To this end, a bit error rate ("BER") check may be used as an indicator to monitor and account for the amount of drift. If the noise channel transfer function $\hat{F}_z$ is poorly estimated, the denoised telemetry signal may have a high BER. If the high BER exceeds an acceptable threshold level, recalibration needs to be performed and a new set of estimated transfer function filter coefficients needs to be recorded in the lookup table. In this way, the lookup table can keep accumulating new sets of estimated transfer function filter coefficients based on temperature, operating voltage, and the like. This allows the telemetry system to create a database of transfer function filter coefficients, which improves the ability of the system to eliminate in-band noise by drawing on historical coefficient values generated under different environmental and operating conditions.

Figure 4:
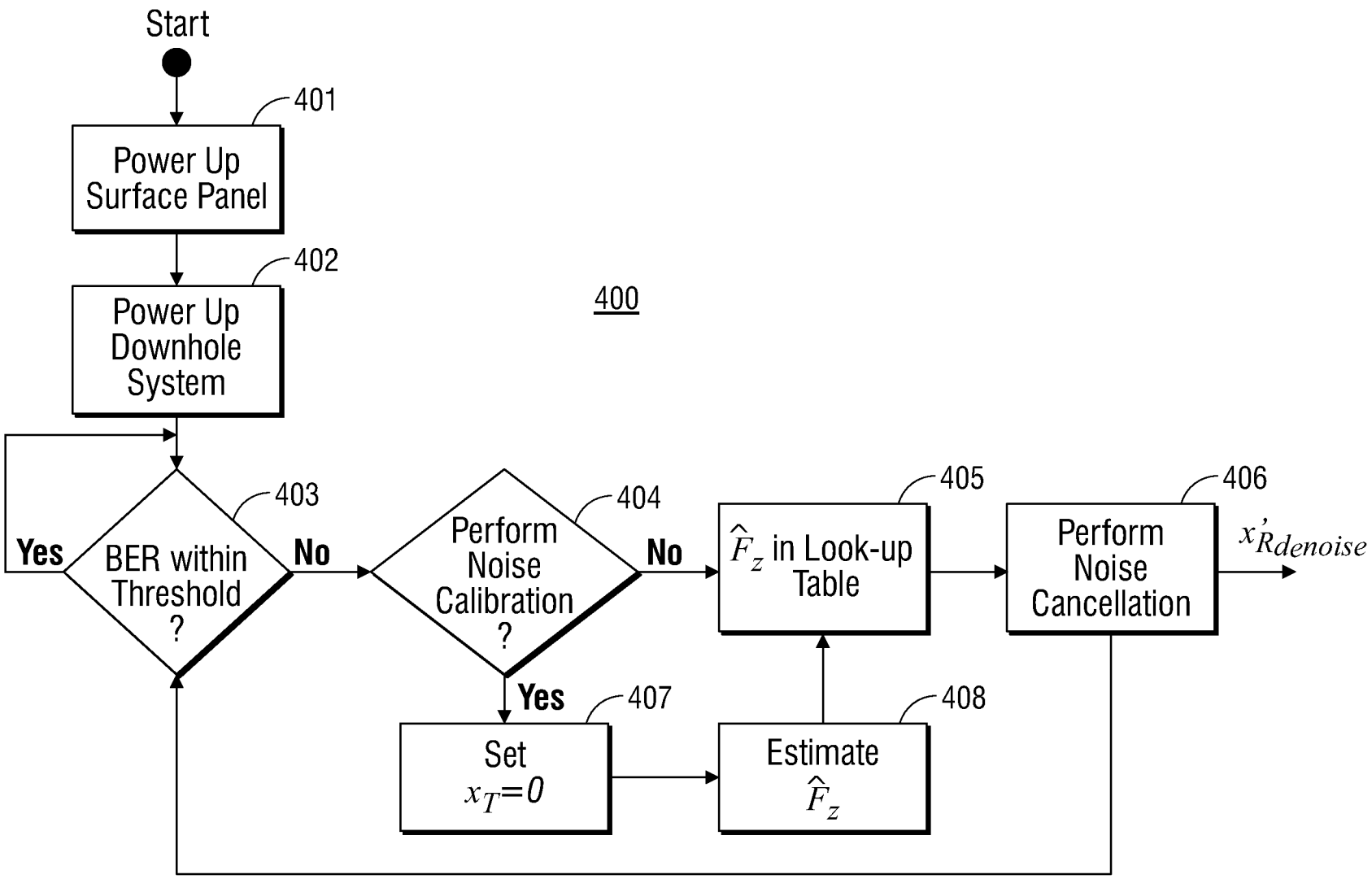
FIG. 4 is a flowchart showing a method for mitigating noise in downhole telemetry systems according to embodiments of the present disclosure.

Referring now to FIG. 4, a flow chart is shown illustrating a method 400 that may be used for active noise cancellation in a wireline telemetry system according embodiments of the present disclosure. The method generally begins at block 401 where the surface panel (e.g., surface panel 301) is powered up, for example, by an operator. At block 402, the downhole system (e.g., telemetry module 312) is powered up, and at block 403, a BER is obtained and compared to a threshold value. If the BER is within the threshold value, meaning the telemetry signals are not experiencing an unacceptable level of interference, then the method simply continues to monitor the BER at regular intervals to ensure the system is sufficiently cancelling out any in-band noise.

If the BER is found to be outside the threshold value at block 403, then the method 400 proceeds with noise cancellation in order to improve the BER. Before performing noise cancellation, the method checks at block 404 to determine whether calibration for noise needs to be performed. If no noise calibration needs to be performed, then the method proceeds to block 405 to look up an estimated noise channel transfer function $\hat{F}_z$ from the lookup table using the current environmental and operating parameters. The noise channel transfer function $\hat{F}_z$ is then used to perform noise cancellation at block 406 in the manner described above.

If calibration needs be performed, then the method proceeds to block 407 where the telemetry signal $x_T$ is set equal to zero and an estimated noise channel transfer function $\hat{F}_z$ is obtained at block 408 in the manner described above. The noise channel transfer function $\hat{F}_z$ (or filter coefficients therefor) is then stored in the lookup table at block 405 along with the environmental and operating parameters therefor, and the method proceeds to block 406 to perform noise cancellation. The resulting de-noised signal $x_{Rdenoise}'$ is then provided to the surface panel.

With respect to the calibration determination at block 404, calibration needs to be performed when there is no estimated noise channel transfer function $\hat{F}_z$ in the lookup table for the current temperature, operating voltage, or the like. Calibration also needs to be performed when the BER does not improve after loading the estimated noise channel transfer function $\hat{F}_z$ from the lookup table. In general, the BER should be sufficiently improved after noise cancellation is performed (i.e., at block 406). That noise cancellation is performed using a previously stored estimated noise channel transfer function $\hat{F}_z$ from the lookup table in block 405. If the previously stored noise channel transfer function $\hat{F}_z$ still results in a BER that exceeds the predetermined threshold, then the calibration at blocks 407 and 408 should be carried out. Otherwise, no calibration is needed. The newly estimated noise channel transfer function $\hat{F}_z$ is then added to the lookup table at block 405. Such an arrangement provides an adaptive approach to noise cancellation that adjusts the estimated noise channel transfer function $\hat{F}_z$ as needed in response to changing environmental and operational parameters.

Regarding the transfer function filter coefficients in the lookup table, in some embodiments, these coefficients may be modeled using a tensor spline approximation for the frequency bandwidth of the noise channel transfer function at the temperatures and operating voltages encountered by the telemetry system in the well. The coefficients are a function of frequency at a particular temperature and a particular operating voltage and thus can change over time as temperatures and operating voltages change. The lookup table can therefore accumulate multiple coefficients at different temperatures and voltages as the telemetry system is operated under varying temperatures and operating voltages. A tensor spline approximation can be used to model the resulting 3-dimensional dataset (frequency, temperature, and operating voltage) in similar manner to the way a regression line approximation can be used to model a 2-dimensional dataset.

In some embodiments, low-pass filter coefficients for the modem can be optimized to prevent saturation of the modem such that the modem can be implemented using, or based on, a smaller number of low-pass filter coefficients. The smaller number of low-pass filter coefficients allows the number of electrical components required by the modem to be reduced, thereby reducing required hardware cost.

In the illustrative embodiments, noise was described with respect to the motor noise generated by a well tractor in a well intervention telemetry system. It should be understood, however, that embodiments of the disclosure are no so limited, and that filter coefficients may be derived with respect to noise generated by a broader array of sources besides a tractor motor. In general, in addition to deriving the estimated transfer function $\hat{F}_z$ (or filter coefficients therefor) from the tractor noise, the estimated transfer function $\hat{F}_z$ can also be derived from a correlation matrix of both the input and the output signals for $\hat{F}_z$. For example, applying an inverse Fourier Transform to the resultant noise signal $w_n$ from Equation 1 above shows that the resultant noise signal can be expressed as $w'(n)=\Sigma_{n=0}^{M-1}f(k)I_n(n-k)$. Note also that performance of a filter can be quantified by a mean squared error (MSE). An optimized filter coefficient can thus be achieved by minimizing the mean square error, for example, by setting the derivative of the mean square error equal to zero. The following steps shows the derivation of the filter coefficient from the correlation matrix of both the input and output signals of $\hat{F}_z$:

$$MSE = E[|w_n' - w_n|^2] \tag{8}$$

$$\frac{\partial MSE}{\partial h^*[l]} = 0 \tag{9}$$

$$\gamma_{wI}[n] = \sum_{n=0}^{M-1} f(k)\gamma_{II}[n-k] \tag{10}$$

In the above equations, $\gamma_{wI}$ [n] is the cross-correlation matrix between the output and input signals for $F_z$ and $\gamma_{II}$[n] is the auto correlation matrix of the input signal for $F_z$. Representing $F_z$ in matrix notation, the optimized filter coefficient can be expressed as:

$$F_{z_{opt}} = \gamma_{II}^{-1}\gamma_{wI} \tag{11}$$

From Equation 11, it can be seen that filter coefficients may also be derived by using a correlation matrix of measured instantaneous input and output of the estimated channel transfer function $\hat{F}_z$. This provides another way to derive filter coefficients in addition to the one discussed with respect to the adaptive method/algorithm 400 of FIG. 4, and is also generally applicable to that embodiment.

Figure 5:
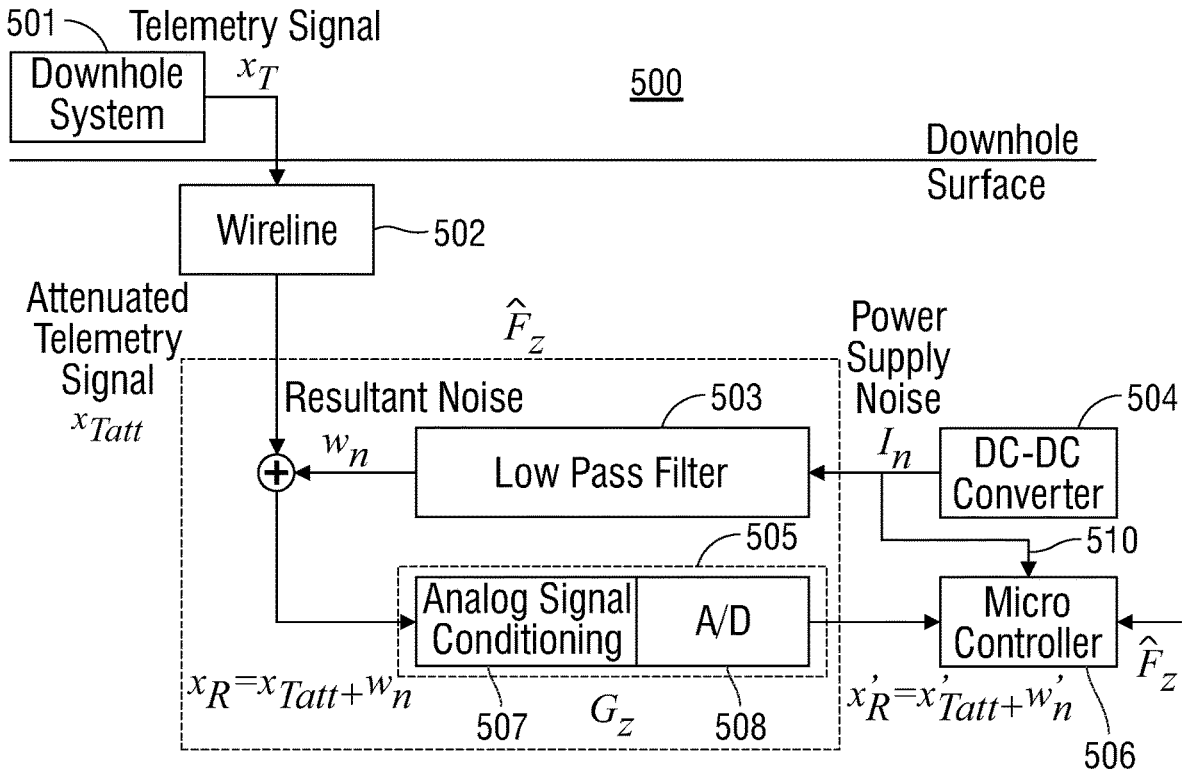
FIG. 5 is a block diagram showing another well telemetry system according to embodiments of the present disclosure.

Turning now to FIG. 5, in some embodiments, instead of performing the noise cancellation described herein at the downhole end of the telemetry system (see FIGS. 3A-3D), it is possible to switch the orientation of the system to perform the noise cancellation at the surface. In these embodiments, the noise that the telemetry system is configured to remove is noise from the surface power system, for example, a DC-DC converter, or any other device that produces power noise, pulses, and/or generates interference over the power lines. This is particularly applicable for open-hole and cased-hole environments provided the noise is generated by a device from which the transfer function $\hat{F}_z$ may be estimated based on the actual transfer function of the system $G_z$.

Referring to FIG. 5, a block diagram is shown illustrating a telemetry system 500 in which the downhole system 501 provides telemetry signal $x_t$ up to the surface through wireline 502. The telemetry signal is attenuated as it travels through the wireline 502, and at the surface, the equipment for monitoring and controlling the downhole system receives the attenuated telemetry signal $x_{Tatt}$. The attenuated telemetry signal $x_{Tatt}$ travels through modem receiver 505, which includes analog signal conditioning circuitry 507, then through analog-to-digital conversion circuitry 508 before being provided directly to microcontroller 506. A DC-DC converter 504 in the downhole system 501 (e.g., in a downhole equipment power supply) provides power to the system. The power provided by the DC-DC converter 504 includes a power supply noise signal $I_n$ that is filtered through low pass filter 503. The low pass filter 503 produces a resultant noise signal $w_n$ that is introduced onto wireline 502. The resultant noise signal $w_n$ is combined with the attenuated telemetry signal, such that the actual signal provided to the modem receiver 505 is again $x_R = x_{Tatt} + w_n$.

In the FIG. 5 embodiment, as with the motor embodiments, a noise signal $I_n$ from a noise source is provided directly to microcontroller 506 via a noise signal path 510, such as an electrical connection from the noise source directly to the microcontroller 506. As mentioned, the source of the noise signal $I_n$ be any source of electrical noise coupled to the wireline 502 within the scope of the present disclosure. The microcontroller 506 thereafter provides the noise cancellation functionality in four main steps or stages: (a) calibration for noise, (b) noise cancellation, (c) bit error rate checking, and (d) repetition of (a)-(b). These steps or stages largely track the noise cancellation steps or stages described earlier with the exception that the noise cancellation is performed at the surface end of the telemetry system instead of the downhole end.

Accordingly, as set forth herein, embodiments of the present disclosure may be implemented in a number of ways. For example, in one aspect, embodiments of the present disclosure relate to a telemetry system for use in an oil and gas well. The system comprises, among other things, a surface panel operable to transmit and receive a telemetry signal through a cable extending along a wellbore and a power converter coupled to the cable and configured to convert electrical power from the cable into operating power for a downhole tractor motor. The system further comprises a modem coupled to the cable and operable to receive and transmit the telemetry signal through the cable and a microcontroller coupled to the modem and operable to receive the telemetry signal from the modem. A noise signal pathway couples the microcontroller to the tractor motor, the noise signal pathway providing a noise signal from the tractor motor to the microcontroller, the noise signal representative of electrical noise generated by the tractor motor. The microcontroller is operable to record the noise signal and perform noise cancellation on the telemetry signal from the modem to produce a de-noised telemetry signal by obtaining an estimated noise channel transfer function for the noise signal, and applying the estimated noise channel transfer function and the noise signal to the telemetry signal from the modem.

In accordance with any one or more of the foregoing embodiments, the estimated noise channel transfer function is derived by setting the telemetry signal to zero to identify the noise signal, and/or by estimating the power converter transfer function and the modem transfer function.

In accordance with any one or more of the foregoing embodiments, the microcontroller obtains the estimated noise channel transfer function from a lookup table that stores the estimated noise channel transfer function as one or more filter coefficients, the one or more filter coefficients being derived using a tensor spline approximation for a frequency bandwidth of the noise channel transfer function at a given well temperature and a given operating voltage of the downhole tractor motor, the one or more filter coefficients being derived using a correlation matrix of an input and an output of the estimated noise channel transfer function, and/or the one or more filter coefficients are optimized by setting a derivative of a mean square error for the one or more filter coefficients to zero.

In accordance with any one or more of the foregoing embodiments, the microcontroller is further operable to determine a bit error rate for the de-noised telemetry signal and obtain a new estimated noise channel transfer function if the bit error rate exceeds a threshold value.

In general, in another aspect, embodiments of the present disclosure relate to a telemetry module for use in an oil and gas well. The telemetry module comprises, among other things, a modem operable to receive a telemetry signal through a cable coupled to the modem and a microcontroller coupled to the modem and operable to receive the telemetry signal from the modem. A noise signal pathway couples the microcontroller to a source of electrical noise, the noise signal pathway providing a noise signal to the microcontroller representative of the electrical noise. The microcontroller is operable to record the noise signal and perform noise cancellation on the telemetry signal from the modem to produce a de-noised telemetry signal by obtaining an estimated noise channel transfer function for the noise signal, and applying the estimated noise channel transfer function and the noise signal to the telemetry signal from the modem.

In accordance with any one or more of the foregoing embodiments, the estimated noise channel transfer function is derived by setting the telemetry signal to zero to identify the noise signal.

In accordance with any one or more of the foregoing embodiments, the microcontroller obtains the estimated noise channel transfer function from a lookup table that stores the estimated noise channel transfer function as one or more filter coefficients, the one or more filter coefficients being derived using a tensor spline approximation for a frequency bandwidth of the noise channel transfer function at a given well temperature and a given operating voltage, the one or more filter coefficients being derived using a correlation matrix of an input and an output of the estimated noise channel transfer function, and/or the one or more filter coefficients are optimized by setting a derivative of a mean square error for the one or more filter coefficients to zero.

In accordance with any one or more of the foregoing embodiments, the microcontroller is further operable to determine a bit error rate for the de-noised telemetry signal and obtain a new estimated noise channel transfer function if the bit error rate exceeds a threshold value.

In general, in yet another aspect, embodiments of the present disclosure relate to a method enhancing telemetry communication in a well intervention operation. The method comprises, among other things, transmitting a telemetry signal through a cable extending along a wellbore and receiving the telemetry signal from the cable at a modem coupled to the cable. The method further comprises providing the telemetry signal from the modem to a microcontroller coupled to the modem and providing a noise signal to the microcontroller through a noise signal pathway between the microcontroller and a source of electrical noise represented by the noise signal. Noise cancellation is performed by the microcontroller on the telemetry signal from the modem to obtain a de-noised telemetry signal, including obtaining an estimated noise channel transfer function for the noise signal, and applying the estimated noise channel transfer function and the noise signal to the telemetry signal from the modem.

In accordance with any one or more of the foregoing embodiments, the estimated noise channel transfer function is derived by setting the telemetry signal to zero and identifying the noise signal, and estimating a modem transfer function for the modem and a power converter transfer function for a power converter coupled to the cable.

In accordance with any one or more of the foregoing embodiments, the microcontroller obtains the estimated noise channel transfer function from a lookup table that stores the estimated noise channel transfer function as one or more filter coefficients.

In accordance with any one or more of the foregoing embodiments, the microcontroller determines a bit error rate for the de-noised telemetry signal and obtains a new estimated noise channel transfer function if the bit error rate exceeds a threshold value.

Further, although reference has been made to uphole and downhole directions, it will be appreciated that this refers to the run-in direction of the tool, and that the tool is useful in horizontal casing run applications, and the use of the terms of uphole and downhole are not intended to be limiting as to the position of the plug assembly within the downhole formation.

While the disclosure has been described with reference to one or more particular embodiments, those skilled in the art will recognize that many changes may be made thereto without departing from the spirit and scope of the description. Each of these embodiments and obvious variations thereof is contemplated as falling within the spirit and scope of the claimed disclosure, which is set forth in the following claims.

The invention claimed is:

1. A telemetry module for use in an oil and gas well, comprising:

a modem operable to receive a telemetry signal through a cable coupled to the modem;

a microcontroller coupled to the modem and operable to receive the telemetry signal from the modem; and a noise signal pathway coupled between the microcontroller and a motor, the noise signal pathway providing a noise signal to the microcontroller representative of an electrical noise generated by the motor, wherein both the microcontroller and the motor are located downhole or both are located on a surface uphole;

wherein the microcontroller is operable to record the noise signal and perform noise cancellation on the telemetry signal from the modem to produce a de-noised telemetry signal by obtaining an estimated noise channel transfer function for the noise signal, and applying the estimated noise channel transfer function and the noise signal to the telemetry signal from the modem.

2. The telemetry module of claim 1, wherein the estimated noise channel transfer function is derived by setting the telemetry signal to zero to identify the noise signal.

3. The telemetry module of claim 2, wherein the microcontroller obtains the estimated noise channel transfer function from a lookup table that stores the estimated noise channel transfer function as one or more filter coefficients.

4. The telemetry module of claim 3, wherein the one or more filter coefficients are derived using a tensor spline for a frequency bandwidth of the noise channel transfer function at a given well temperature and a given operating voltage.

5. The telemetry module of claim 3, wherein the one or more filter coefficients are derived using a correlation matrix of an input and an output of the estimated noise channel transfer function.

6. The telemetry module of claim 5, wherein the one or more filter coefficients are optimized by setting a derivative of a mean square error for the one or more filter coefficients to zero.

7. The telemetry module according to claim 1, wherein the microcontroller is further operable to determine a bit error rate for the de-noised telemetry signal and obtain a new estimated noise channel transfer function if the bit error rate exceeds a threshold value.

8. A telemetry system for use in an oil and gas well, comprising:

a surface panel operable to transmit and receive a telemetry signal through a cable extending along a wellbore;

a power converter coupled to the cable and configured to convert electrical power from the cable into operating power for a downhole tractor motor;

a modem coupled to the cable and operable to receive and transmit the telemetry signal through the cable;

a microcontroller coupled to the modem and operable to receive the telemetry signal from the modem; and a noise signal pathway coupling the microcontroller to the tractor motor, the noise signal pathway providing a noise signal from the tractor motor to the microcontroller, the noise signal representative of electrical noise generated by the tractor motor, wherein both the microcontroller and the tractor motor are located downhole or both are located on a surface uphole;

wherein the microcontroller is operable to record the noise signal and perform noise cancellation on the telemetry signal from the modem to produce a de-noised telemetry signal by obtaining an estimated noise channel transfer function for the noise signal, and applying the estimated noise channel transfer function and the noise signal to the telemetry signal from the modem.

9. The telemetry system of claim 8, wherein the estimated noise channel transfer function is derived by setting the telemetry signal to zero to identify the noise signal.

10. The telemetry system of claim 8, wherein the estimated noise channel transfer function is derived by estimating a power converter transfer function and a modem transfer function.

11. The telemetry system of claim 8, wherein the microcontroller obtains the estimated noise channel transfer function from a lookup table that stores the estimated noise channel transfer function as one or more filter coefficients.

12. The telemetry system of claim 11, wherein the one or more filter coefficients are derived using a tensor spline for a frequency bandwidth of the noise channel transfer function at a given well temperature and a given operating voltage of the downhole tractor motor.

13. The telemetry system of claim 11, wherein the one or more filter coefficients are derived using a correlation matrix of an input and an output of the estimated noise channel transfer function.

14. The telemetry system of claim 13, wherein the one or more filter coefficients are optimized by setting a derivative of a mean square error for the one or more filter coefficients to zero.

15. The telemetry system according to claim 8, wherein the microcontroller is further operable to determine a bit error rate for the de-noised telemetry signal and obtain a new estimated noise channel transfer function if the bit error rate exceeds a threshold value.

16. A method enhancing telemetry communication in a well intervention operation, the method comprising:

transmitting a telemetry signal through a cable extending along a wellbore;

receiving the telemetry signal from the cable at a modem coupled to the cable;

providing the telemetry signal from the modem to a microcontroller coupled to the modem;

providing a noise signal to the microcontroller through a noise signal pathway between the microcontroller and a motor, wherein both the microcontroller and the motor are located downhole or both are located on a surface uphole; and performing noise cancellation by the microcontroller on the telemetry signal from the modem to obtain a de-noised telemetry signal, including obtaining an estimated noise channel transfer function for the noise signal, and applying the estimated noise channel transfer function and the noise signal to the telemetry signal from the modem.

17. The method of claim 16, further comprising deriving the estimated noise channel transfer function by setting the telemetry signal to zero and identifying the noise signal.

18. The method of claim 17, further comprising deriving the estimated noise channel transfer function by estimating a modem transfer function for the modem and a power converter transfer function for a power converter coupled to the cable.

19. The method of claim 18, wherein the microcontroller obtains the estimated noise channel transfer function from a lookup table that stores the estimated noise channel transfer function as one or more filter coefficients.

20. The method according to claim 16, further comprising determining by the microcontroller a bit error rate for the de-noised telemetry signal and obtaining a new estimated noise channel transfer function if the bit error rate exceeds a threshold value.

* * * * *